United States Patent [19]

Rivetti

[11] 4,133,057

[45] Jan. 9, 1979

[54] TOILET SET TO BE INSTALLED IN A MINIMUM SIZE ROOM

[76] Inventor: Stefano Rivetti, No. 31, Via Bertoloni, Rome, Italy

[21] Appl. No.: 812,592

[22] Filed: Jul. 5, 1977

[51] Int. Cl.[2] ..... A47K 4/00; E03D 1/00; A47K 3/20

[52] U.S. Cl. ..... 4/1; 4/3; 4/6; 4/145; 4/300; 4/341; 4/DIG. 2

[58] Field of Search ..... 4/1–7, 4/10, 11, 68, 97, 99, 100, 107, 110, 111, 145, 146, 173 R, 169, 188, 125, 129, 131, 133, DIG. 2, 159, 144.1, 237, 300, 340, 341, 430

[56] References Cited

U.S. PATENT DOCUMENTS

| | | | |
|---|---|---|---|
| 2,184,722 | 12/1939 | McLoughlin | 4/DIG. 2 |
| 2,396,992 | 3/1946 | Evans | 4/2 |
| 2,499,115 | 2/1950 | Shobe | 4/99 X |
| 2,611,134 | 9/1952 | Jarrett et al. | 4/3 X |
| 3,412,408 | 11/1968 | Michal, Jr. | 4/99 |
| 3,436,765 | 4/1969 | Sundberg | 4/131 |
| 3,458,871 | 8/1969 | Valcervo | 4/3 |
| 3,537,110 | 11/1970 | Horie | 4/169 |
| 3,606,616 | 9/1971 | Bucher | 4/6 X |
| 3,713,585 | 1/1973 | Conklin | 4/145 X |
| 4,028,745 | 6/1977 | Caniglia | 4/7 |

*Primary Examiner*—Stuart S. Levy
*Attorney, Agent, or Firm*—Haseltine, Lake, & Waters

[57] ABSTRACT

A toilet set to be installed in a minimum size room comprising in combination a support with a water closet discharge provided at its top with two basins located side by side and slidable at will transversely, in order to serve selectively the functions of a water closet pot and of a bidet, a washing basin which can be tilted to vertical position, a shower delivery, a movable urinal with internal washing and streaming water discharge, a mechanism for delivering water to the aforesaid services connected to a thermostat and a warm air delivery unit associated with the shower and the bidet.

3 Claims, 16 Drawing Figures

FIG. 5
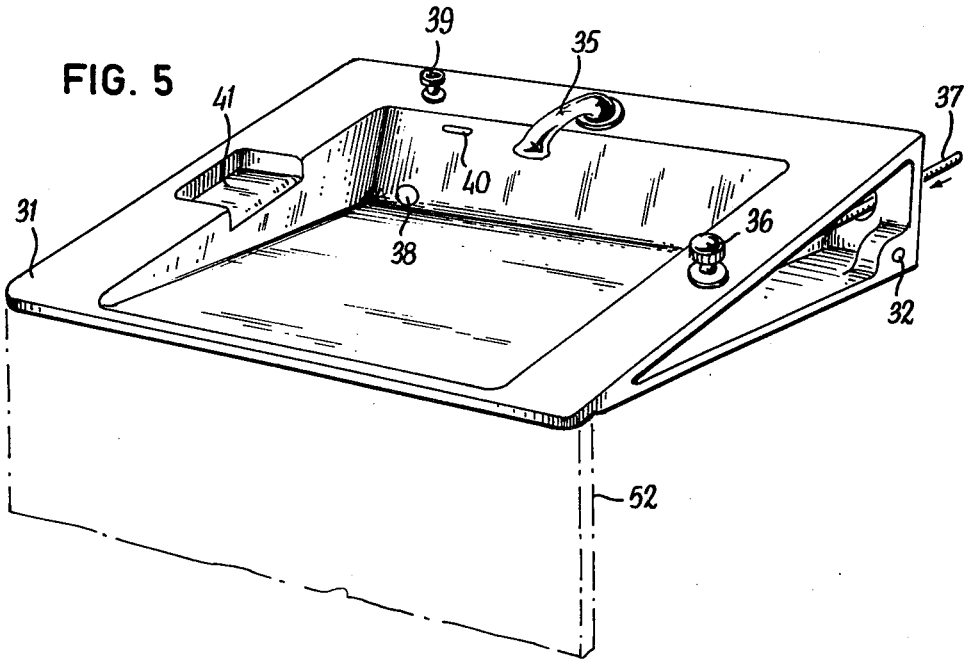
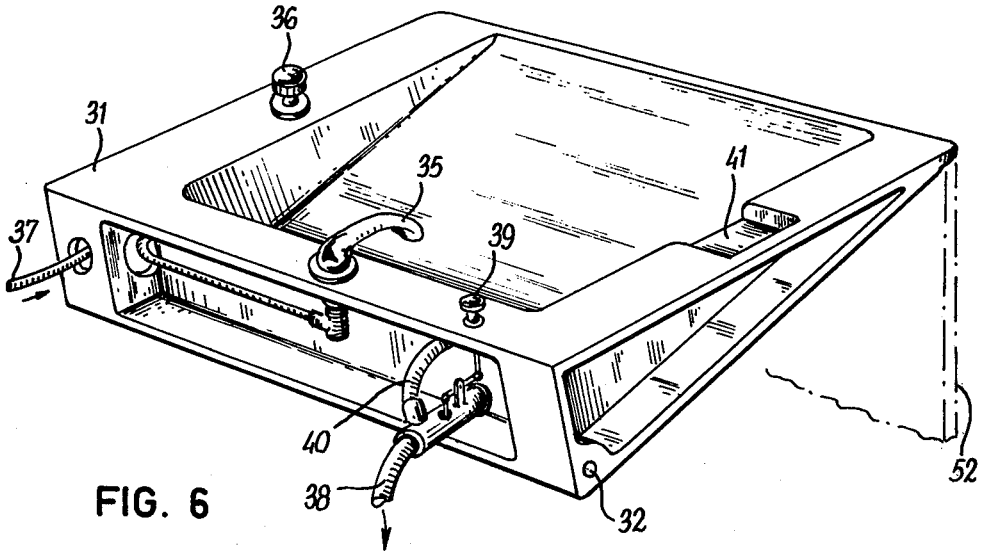
FIG. 6

46
47
45
49
48
44
51
50
43
35
36
31
33
X
X
32
54
52
20
54
52
55
28
3
30
29

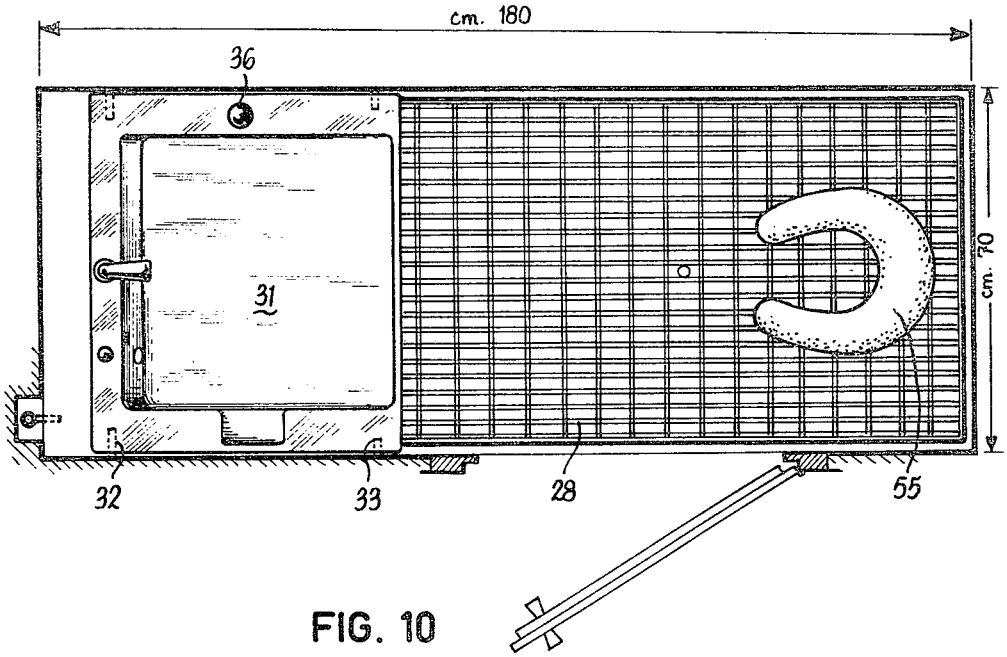
FIG. 10
FIG. 12
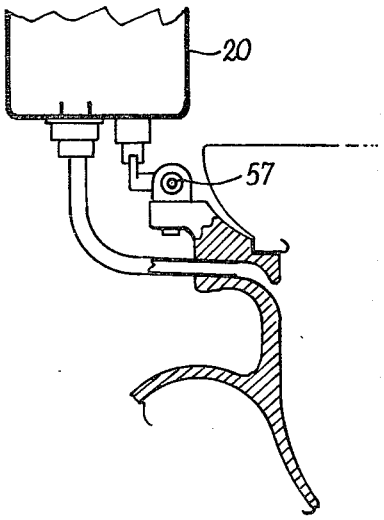
FIG. 11
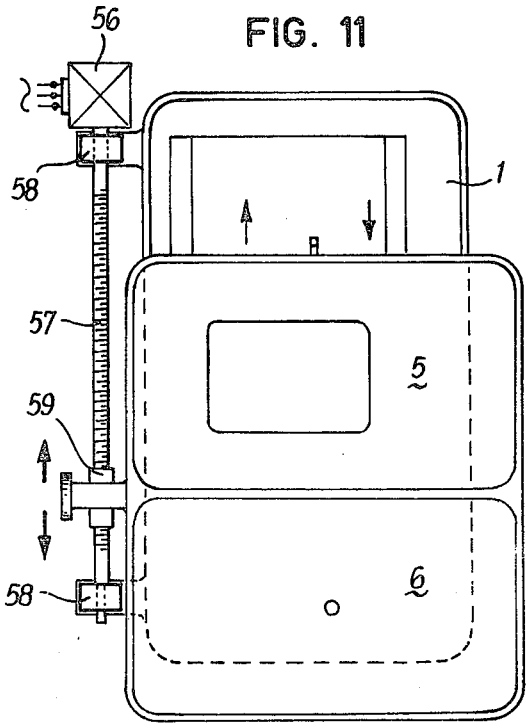

TOILET SET TO BE INSTALLED IN A MINIMUM SIZE ROOM

The present invention relates to a toilet set which can be installed in a room having minimum size.

The purpose of this invention is that of embodying a manufactured product of the related kind, particularly suitable for all applications concerned with residential buildings, and generally in all cases where it is necessary to obtain a bath room with a complete toilet set in a very reduced space.

Another purpose of this invention is that of embodying a bath and toilet unit which can be manufactured and installed under industrial standards, with substantial reduction of the manufacture and labor costs.

According to this invention, a set is provided comprising in combination, a support with a water closet or as commonly referred to a WC discharge provided at its top with two basins located side by side, and slidable at will transversely, in order to serve selectively the functions of a water closet and of a bidet, a seat cover in which are incorporated the delivery pipes of water for washing and for the WC and bidet services, a movable urinal with internal rinsing and streaming discharge water, a wash basin which can be tilted to vertical position, a shower delivery means, water delivery means for said service units connected to a thermostat and warm air delivery means associated with the shower and the bidet.

This invention will be now described with reference to the attached drawings showing by way of non-limitative example, one preferred embodiment of the invention.

In the drawings:

FIGS. 5 and 6 show two perspective views of the tiltable washing basin;

FIG. 10 is a sectional view taken along line X—X in FIG. 7;

FIG. 11 is a top plan view showing the possibility of a power operation of the two WC and bidet basins, and the discharge of the waste water of the WC;

FIG. 12 shows the device of FIG. 11 in sectional view taken along a vertical plane;

Figure 2:
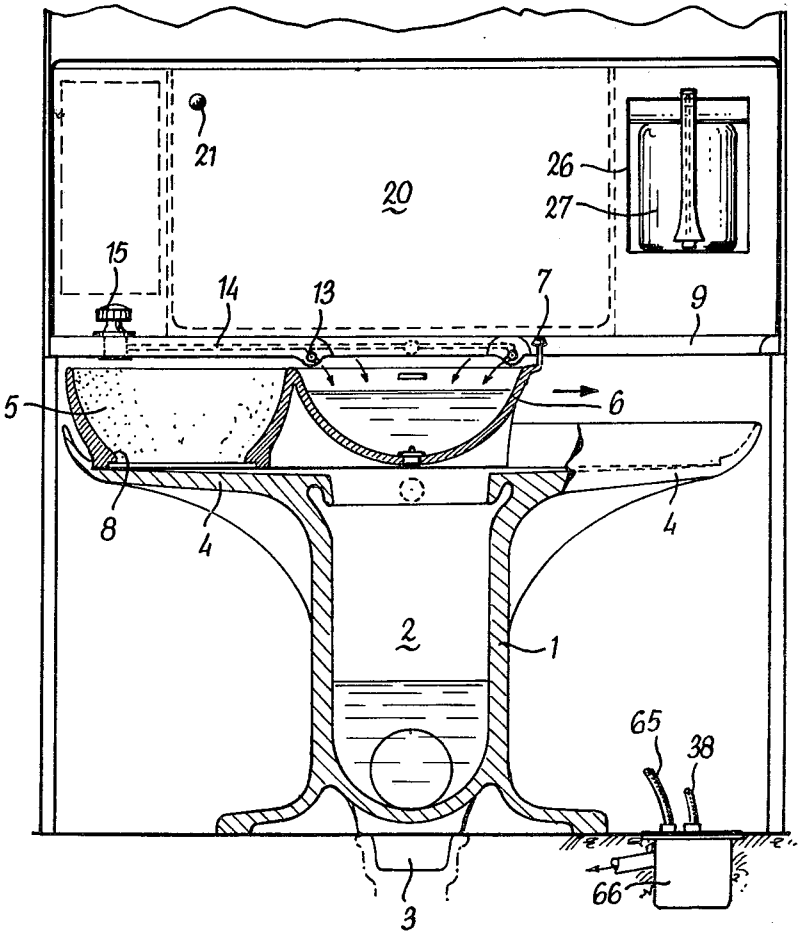
FIG. 2 is a sectional view taken along line II—II in FIG. 1.
Figure 1:
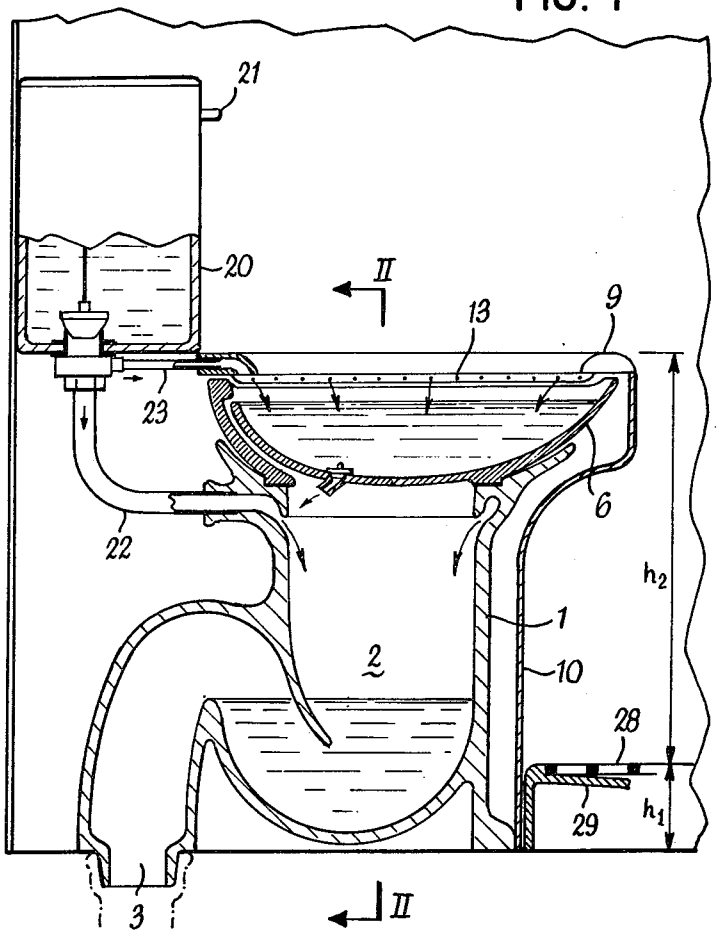
FIG. 1 shows the detail of the water closet-bidet unit, seen in longitudinal section.

With reference to FIGS. 1 and 2, the numeral 1 denotes a conventional type pot-like support, carrying a water siphon 2 leading to a normal waste conduit 3. Above the pot-like support 1 are two integral planar shelves 4 which slidably support two basins 5 and 6 located side by side and movable under the control of lever 7. The basin 5 is provided with a central aperture 8 and serves the function of WC pot while the basin 6 serves the function of a bidet. The entire unit (see also FIGS. 3 and 4) is covered by a cover 9 into which extend the supply and discharge pipes of the WC and of the bidet in bores 11. The seat cover; rests on a front apron 10. In correspondence with the control lever 7, the cover 9 is provided with a guide slot 12.

Figure 3:
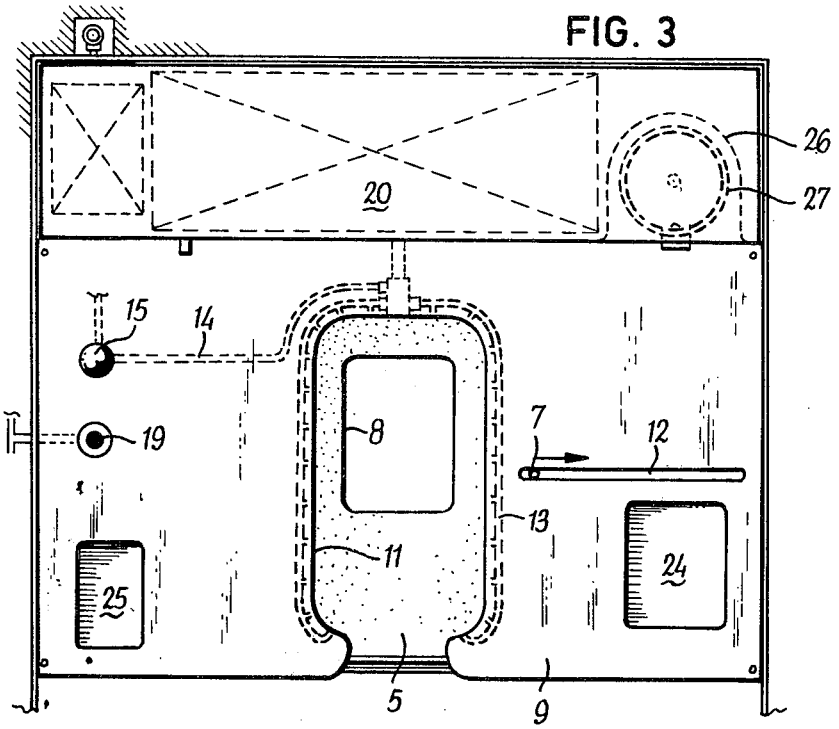
FIG. 3 is a top plan view corresponding to FIG. 1, with the WC basin in its central position.
Figure 4:
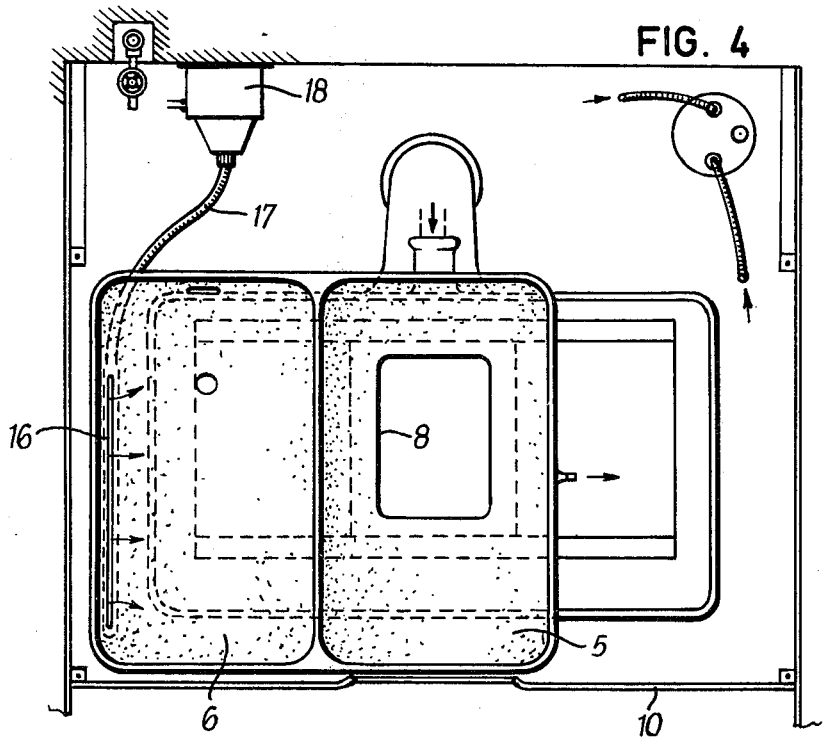
FIG. 4 is a view similar to FIG. 3, with the seat cover removed.

If the WC basin is to be used, the basin 5 will be placed in its central position, as shown in FIGS. 3 and 4, while by operating the lever 7 the basin 6 will be, in turn, carried to its central position serving the bidet function as shown in FIGS. 1 and 2. The size in the aperture of the cover provides for the two functions of use of the WC and of the bidet. The warm or cold water for the bidet 6 will be delivered through a set of holes in a ring provided around the seat 13 and connected to pipe 14 provided with faucet 15. In the bidet basin 6 a slot 16 is provided, supplied by flexible pipe 17 connected to heating element 18 and leading to a control member 19 for delivering a warm air jet for drying.

The discharge box 20, provided with a push button or lever control 21, sends a water jet through the pipe 22 inside the discharge siphon 2 of the WC and simultaneously, through the branched pipe 23 a certain amount of water to the surrounding outlets 13 which will clean the basin 5. At both sides of the seat cover 9 two recesses 24 and 25 are provided for toilet paper and soap.

At the side of the discharge box, a recess 26 is provided in which a urinal 27 is located. The entire floor (FIGS. 1 and 7) is covered by a grid 28 under which inclined surface 29 are provided, for conveying waste water from a shower through the pipe 30 to the discharge conduit 3. The height h1 of the grid 28 with respect to the floor (FIG. 1) is such as to have a conventional height h2 of the seat 9 (about 40 cms).

Figure 7:
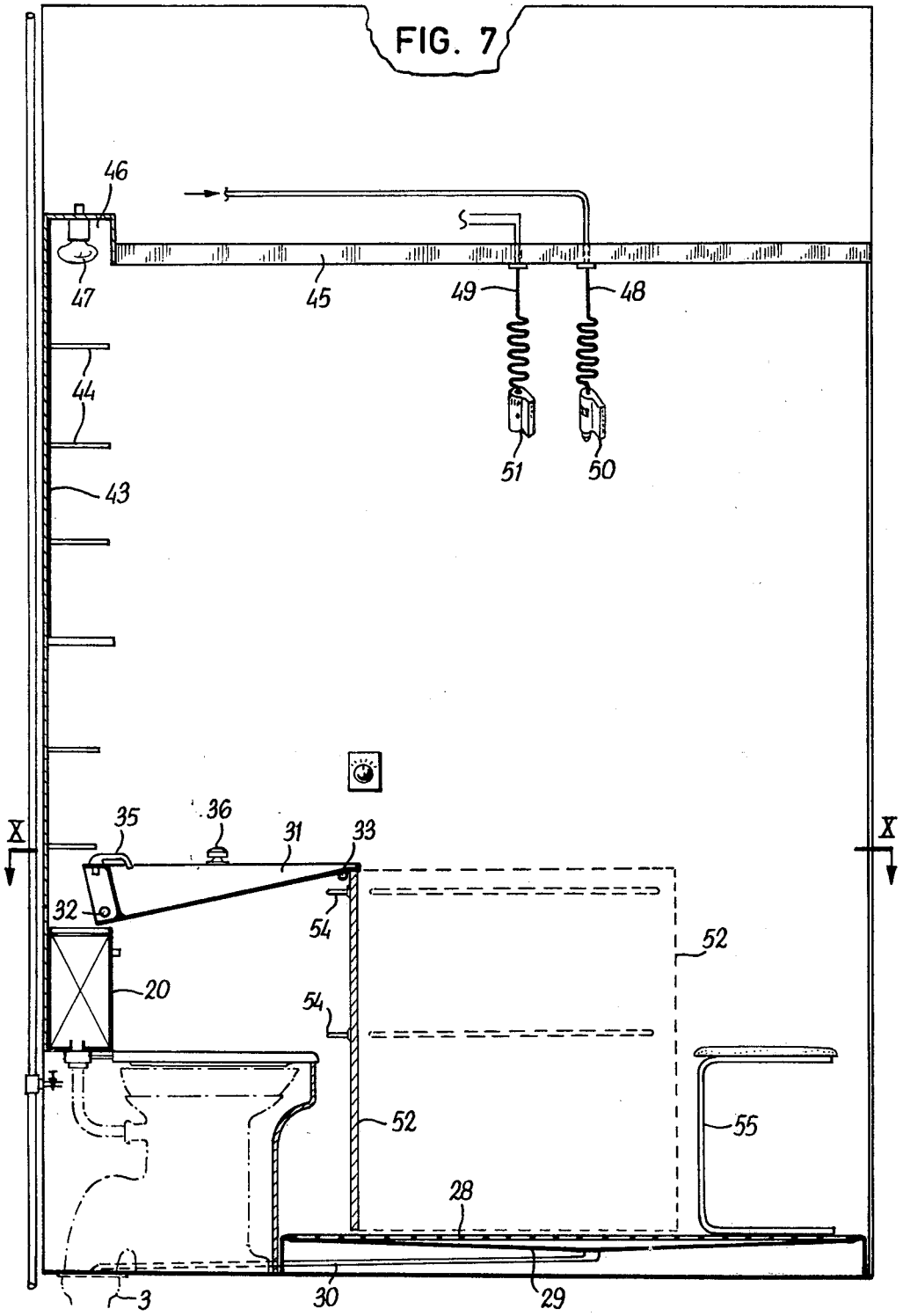
FIG. 7 shows the set partially sectioned according to a vertical plane.
Figure 8:
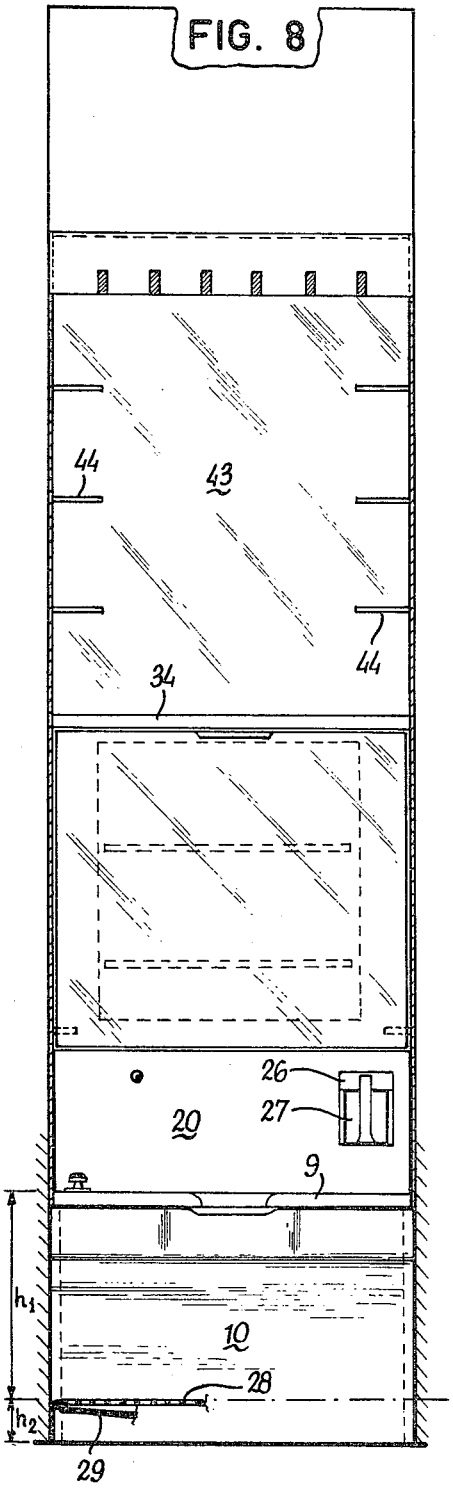
FIG. 8 is a sectional view taken long line VIII—VIII in FIG. 9.
Figure 9:
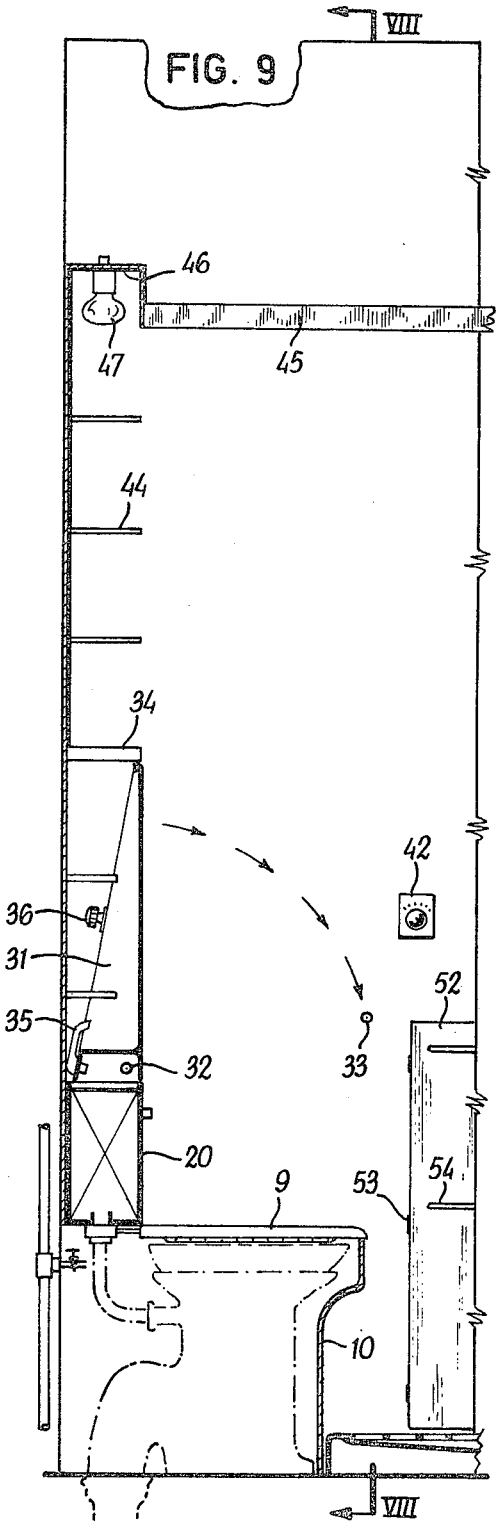
FIG. 9 is a sectional view similar to FIG. 7 with the washing basin in its tilted position.

A washing basin 31 in FIGS. 5, 6 and 7 can be tilted about lateral pivots 32 and is located above the previously described unit. In its operating position, the front edge of the washing basin 31 rests on lateral abutments 33 shown in FIG. 7, while in its rest position (FIGS. 8 and 9) the washing basin will be located under the shelf 34, aligned with the discharge box 20. The washing basin is provided with a delivery spout 35 suitable to deliver warm or cold water under the control of faucet 36 connected through the flexible pipe 37 to a thermostat device 42.

A second flexible pipe 38 serves the function of discharge, and is associated with valve closure 39 and the overflow duct 40. On one edge of washing basin there is a soap stand 41 with a rack in order to prevent the soap from escaping when the washing basin is tilted.

Above the washing basin (FIGS. 7, 8, 9) a mirror 43 is provided surrounded by the shelves 44. On the ceiling 45 near the mirror, a recess 46 is provided, to receive lamps 47.

From the ceiling 45 hang two elastic pipes 48 and 49. The first pipe ends with a shower delivery 50 and the second pipe is provided with a warm air drier 51. When the shower is operating, a door 52 hinged in 53 and provided with a towel rack 54 is located under the washing basin as shown in FIG. 7, in order to protect the towels. The unit is completed by a stool 55 with a horse shoe seat, with or without a back.

As shown in FIG. 10, for installing the bath according to this invention, a recess is sufficient, of about 70 × 180 cms. The last cited dimension can be further reduced, but it must allow the shower to be used also with a person seated on a particular stool, serving also the function of a toilet stool.

FIGS. 11 and 12 show a power control for the displacement of the basins 5 and 6. The power control comprises a motor 56 driving a threaded shaft 57 mounted on supports 58 and associated with sleeve 59 rigid with the unit of the two basins 5 and 6. The rotational movement of the shaft 57 is transformed into a reciprocatory movement of the two basins which will be selectively locked in their desired position by a pair of end-of-stroke switches. In its movement, said control means will operate the discharge valve of the WC.

Figure 13:
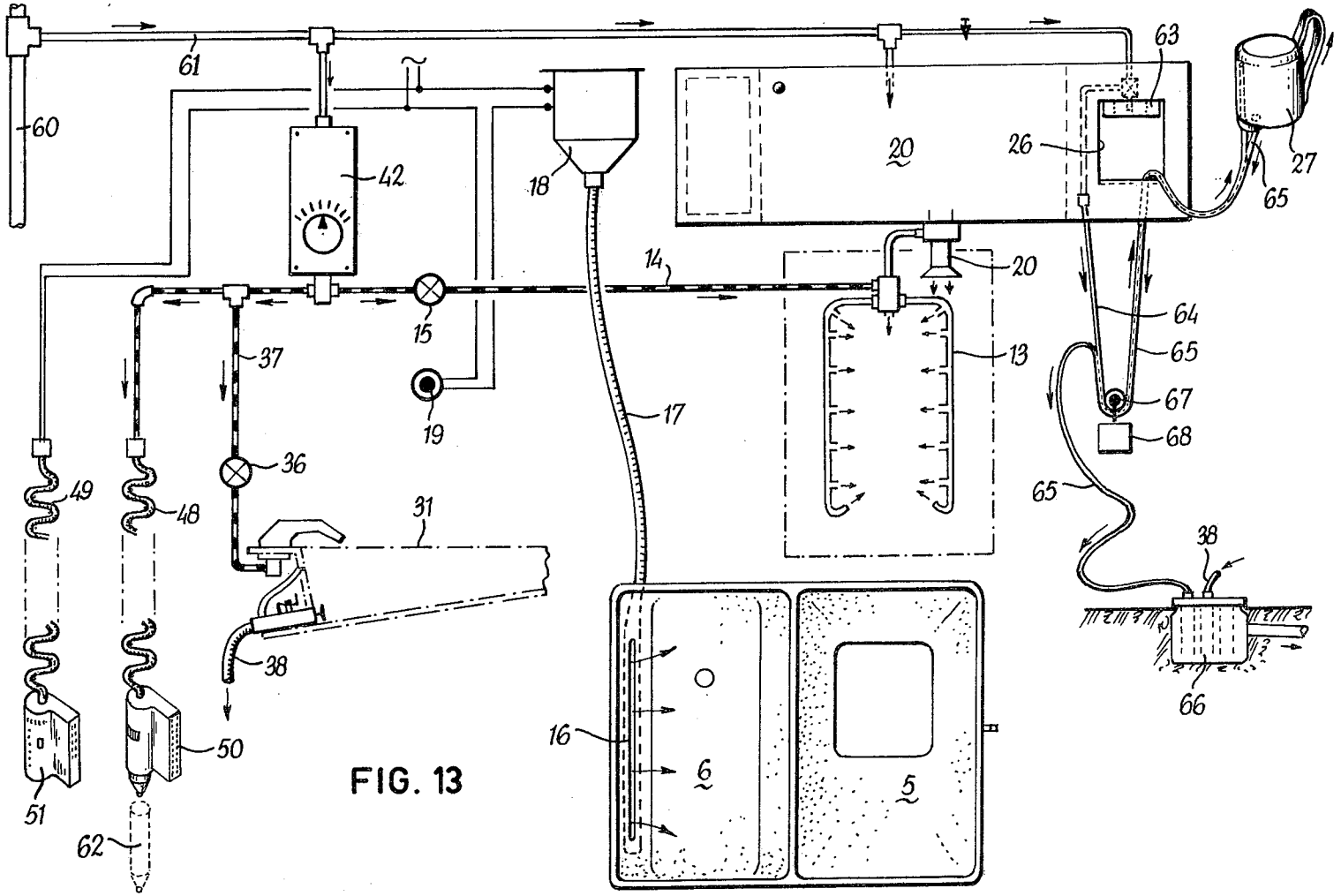
FIG. 13 shows the general diagram of the set with the various fittings and the electric and hydraulic connections.

FIG. 13 shows the general diagram of the unit. As shown in said figure, from the water delivery main 60 a single branch 61 is sufficient in order to supply the entire unit. Said branch 61 is connected to the thermostat 42 supplying the washing basin 31, the outlets 13 of the bidet, the waste pipe WC 20 and the shower 50. Advantageously, the latter can be provided with a rechangeable supply of liquid soap, as shown in 62.

The terminal part of the pipe 61 leads to a valve 63 located in the recess 26 for the urinal 27. When the latter is removed from its recess, the valve 63 will open, the water flows through the flexible pipe 64 and reaches the inside of the urinal 27 thus effecting washing thereof by streaming water. A second flexible waste pipe, associated with the first pipe, conveys the washing water and the urine to the siphon box 66 mounted on the floor. Into said box flows also the discharge 38 from the washing basin. The pulley 67 provided with the counterweight 68 serves the function of recovering the double flexible duct 64-65 when the urinal 27 will be put again into the recess 26. Of course, as soon as the urinal is put in place, the valve 63 will intercept the water flow into the pipe 64.

Figure 14:
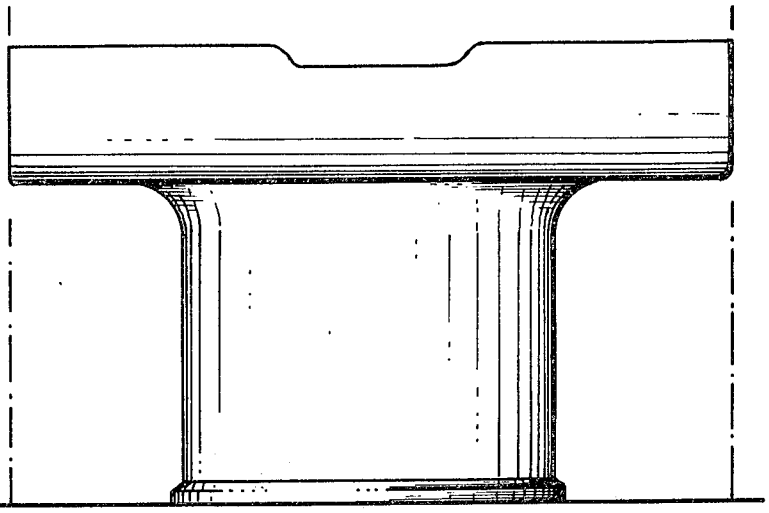
FIGS. 14, 15 and 16 show a variant of the WC bidet set.
Figure 15:
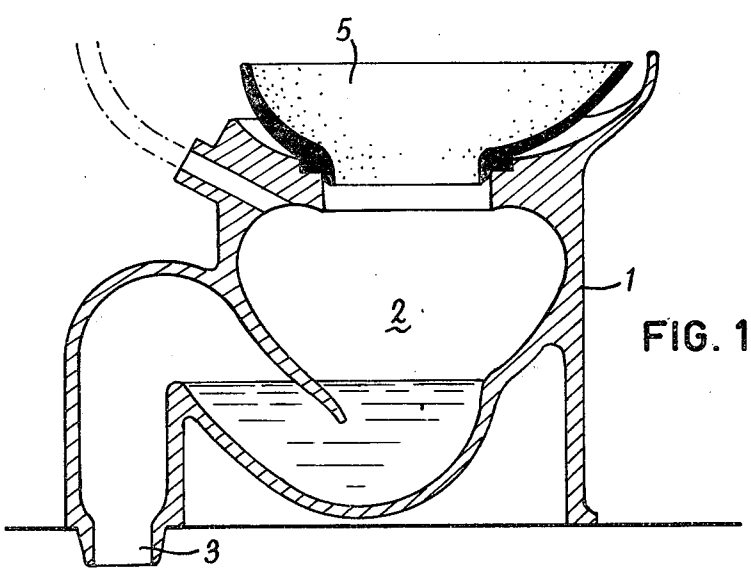
Figure 16:
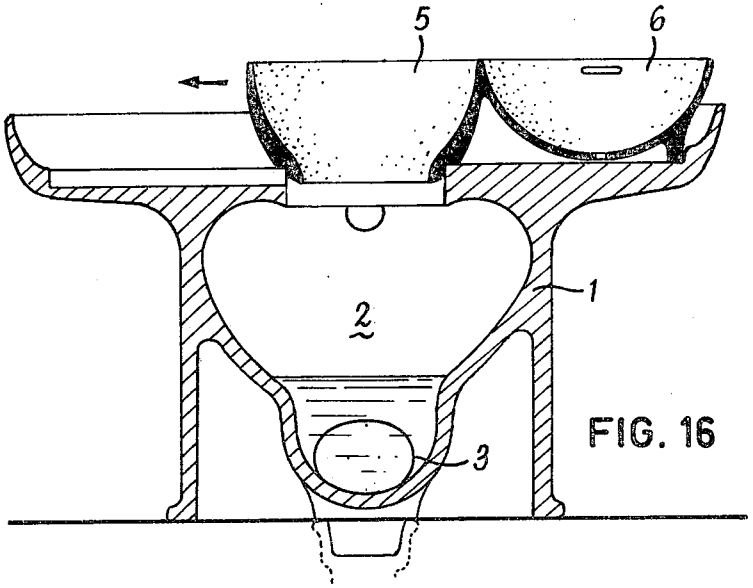

FIGS. 14, 15 and 16 show a variant of the double basin unit 5 and 6 as described with reference to FIGS. 1 to 4. In this case, the shape of the pot-shaped support 1 is such as to dispense with the front apron 10 of FIG. 1 and the internal recess of the water siphon 2 has far greater size.

The present invention has been described with reference to one preferred embodiment it being however understood that constructive variants might be practically adopted without departing from the scope of the present invention.

Having thus described the present invention, what is claimed is:

1. A toilet unit including a plurality of sanitary fittings and comprising in combination a water closet pan and a bidet arranged side by side as a single constructive unit, support means for said pan and bidet unit including a common central siphon discharge conduit, said support means having an upper surface with a central aperture in correspondence with said central conduit, said pan and bidet unit being linearly slidable on said surface, control means for displacing said pan and bidet respectively into the central position with respect to said discharge conduit, a seat cover covering said upper surface and having a central aperture in correspondence with said discharge conduit, said pan and bidet unit being slidable beneath said seat cover for selectively placing said water closet pan and bidet beneath said central aperture in the seat cover, a warm or cold water discharge box supported above said pan and bidet unit, first pipe means connecting said water box with said central discharge conduit adjacent outlets of pan and bidet unit, a plurality of water outlet holes arranged around said aperture in said seat cover, second pipe means connecting said water discharge box with said plurality of water outlet holes, third pipe means connected at one end to a hot air source and at the other end with a slot provided in said bidet, and a tiltable washing basin supported above said water box.

2. A toilet unit as claimed in claim 1, wherein said control means comprises a manually operated lever connected to said pan and bidet unit and displaceable within a slot provided in said seat cover.

3. A toilet unit as claimed in claim 1, wherein said control means comprises an electric motor rotating a threaded shaft for displacing a sleeve fastened to said pan and bidet unit.

* * * * *